US005586897A

United States Patent [19]

Shinji et al.

[11] Patent Number: 5,586,897

[45] Date of Patent: Dec. 24, 1996

[54] WATERPROOF CONNECTOR

[75] Inventors: Yasuhisa Shinji; Hiraji Takase, both of Shizuoka-ken, Japan

[73] Assignee: Yazaki Corporation, Tokyo, Japan

[21] Appl. No.: 518,138

[22] Filed: Aug. 22, 1995

[30] Foreign Application Priority Data

Aug. 25, 1994 [JP] Japan ..... 6-200734

[51] Int. Cl.[6] ..... H01R 13/52

[52] U.S. Cl. ..... 439/271; 439/273

[58] Field of Search ..... 439/271–276, 439/586, 587, 588, 589, 281, 282, 283

[56] References Cited

U.S. PATENT DOCUMENTS

| | | | |
|---|---|---|---|
| 4,917,620 | 4/1990 | Samjima et al. | 439/272 |
| 5,328,382 | 7/1994 | Pawliki | 439/273 |
| 5,336,101 | 8/1994 | Kasugai | 439/273 |
| 5,389,005 | 2/1995 | Kodama | 439/272 |

*Primary Examiner*—David Pirlot

*Attorney, Agent, or Firm*—Finnegan, Henderson, Farabow, Garrett & Dunner, L.L.P.

[57] ABSTRACT

A waterproof connector (1) comprises: a connector housing (30) having an opening (5) engaged with a mated connector housing; a packing (10) disposed within the opening of the connector housing, for sealing a space between the two mated connector housings, at least one part (10*a*) of the packing being exposed outside through at least one hole (12) formed in the connector housing; and a protective cover (40) selectively attached to the connector housing from the outside at need, for covering at least one exposed part (10*a*) of the packing according to the required degree of connector waterproof characteristics. The protective cover is preferably formed of a hard plastic resin and preferably formed with locking elements (48, 50) locked with other locking elements (28, 28*a*) formed in the connector housing. When the protective cover (40) is attached to the connector housing, the waterproof connector is usable for a connector disposed under an engine for an automotive vehicle as a waterproof connector resistant against a high-pressure washing water jet stream.

5 Claims, 3 Drawing Sheets

WATERPROOF CONNECTOR

BACKGROUND OF THE INVENTION

1. Technical Field

The present invention relates to a waterproof connector, and more specifically to a waterproof connector provided with a sealing packing inside a connector housing.

2. Description of the Related Art

In the conventional waterproof connector, for instance, a female connector housing is formed with an opening mated with a male connector housing and further with an inside wall having holes through which metal terminals are passed. Therefore, when the male connector housing is mated with the opening of the female connector housing, the terminals housed in the female connector housing can be engaged with other terminals housed in the male connector housing.

Here, in the case of the waterproof type connector, a rubber sealing packing is usually disposed in contact with the inner wall of the female connector housing at a corner portion (at which the inner wall and the circumferential wall of the female connector housing intersect each other) in such a way as to enclose the metal terminals. Therefore, when the male connector housing is mated with the female connector housing, since the front end portion of the male connector housing is brought into tight contact with the packing housed in the female connector housing, it is possible to seal a space between the front end portion of the male connector housing and the inside wall of the female connector housing.

In the waterproof connector of this type, the connector housing is usually formed with some (e.g., two) through holes in the outer circumferential wall of the female connector housing to support the packing in position within the female connector housing and further to confirm the correct position of the assembled packing in the connector housing. Therefore, the packing is usually left exposed outside through these through holes.

When the waterproof connector as described above is used under the normal condition (e.g., normal sealing condition), there exists no problem. However, when the waterproof connector disposed under an engine of an automotive vehicle is exposed to a high-pressure washing water jet stream, for instance, since a high pressure water is directly jetted against the exposed packing, there exists a possibility that the packing is deformed and thereby water enters the waterproof connector housing.

To overcome this problem, it may be possible to fix a protective cover for protecting the exposed packing to the waterproof connector housing. In this case, however, since the protective cover must be of high-pressure waterproof type usable only for the high-quality waterproof type, so that the cost thereof becomes relatively high. In addition, when the packing is covered with an appropriate cover perfectly from the first, there exists another problem in that the engaging condition of the packing cannot be confirmed from the outside after the waterproof connector has been fixed in position.

SUMMARY OF THE INVENTION

With these problems in mind, therefore, it is the object of the present invention to provide a waterproof connector which can be used both for the ordinary waterproof type and for the high-pressure waterproof type, separately.

To achieve the above-mentioned object, the present invention provides a waterproof connector (1), comprising: a connector housing (30) having an opening (5) engaged with a mated connector housing; a packing (10) disposed within the opening of said connector housing, for sealing a space between the two mated connector housings, at least one part (10*a* ) of said packing being exposed outside through at Least one hole (12) formed in said connector housing; and a protective cover (40) selectively attached to said connector housing from the outside at need, for covering at least one exposed part (10*a* ) of said packing according to a required degree of connector waterproof characteristics.

Further, the protective cover (40) is formed into a cylindrical shape in correspondence to a shape of said connector housing, and further engaged with said connector housing being slid on and along an outer circumferential wall (6) of said connector housing.

Further, the connector housing (30) has a plurality of convex portions (22, 24, 26) formed in an outer wall surface thereof, and said protective cover (40) has a plurality of concave portions (42, 44, 46) formed in an inner wall surface thereof so as to be engaged with a plurality of the outer convex portions (22, 24, 26) of said connector housing, respectively.

Further, the connector housing (30) is formed with a pair of slots (28) each having a lock hole (28*a* ) at an end of each slot; and said protective cover (40) comprises locking means composed of: a pair of flexible arms (48) formed on both side surfaces thereof, respectively so as to be engaged with two slots (28) of the connector housing, separately; and a pair of lock projections (50) each formed at each free end of said flexible arms so as to be engaged with each lock hole (28*a* ) formed at each end of the slots, separately.

Further, the protective cover (40) is formed of a hard plastic resin.

As described above, in the waterproof connector according to the present invention having a packing supported by holes formed in the connector housing (for packing position confirmation), it is possible to provided two types of the waterproof connectors of low and high waterproof characteristics, by not attaching or by simply attaching the protective cover to the connector housing, after the connector terminals and the packing have been all assembled in position within the connector housing. As a result, it is possible to economize the number of the molding dies and thereby to reduce the cost of the waterproof connector, in particularly of the specific high-pressure type waterproof connector.

Further, since the connector housing and the protective cover are formed into square cylindrical shape and further since the locking means is provided between the connector housing and the protective cover, the protective cover can be stably and firmly engaged with the outside surface of the connector housing, without being rotated by a high-pressure washing water jet stream.

DETAILED DESCRIPTION OF THE EMBODIMENTS

An embodiment of the waterproof connector according to the present invention will be described hereinbelow with reference to the attached drawings.

Figure 1:
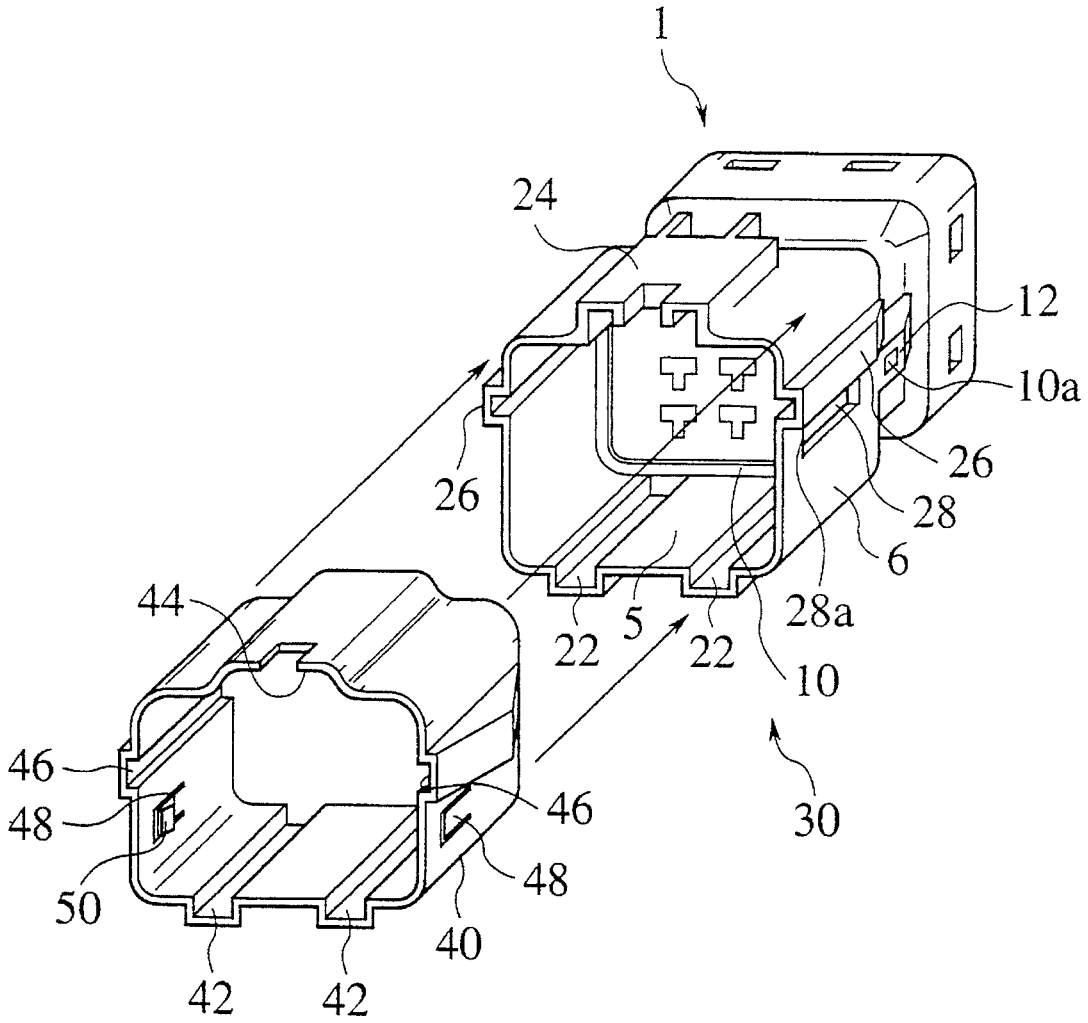
FIG. 1 is a perspective view showing an embodiment of the waterproof connector according to the present invention.
Figure 2A:
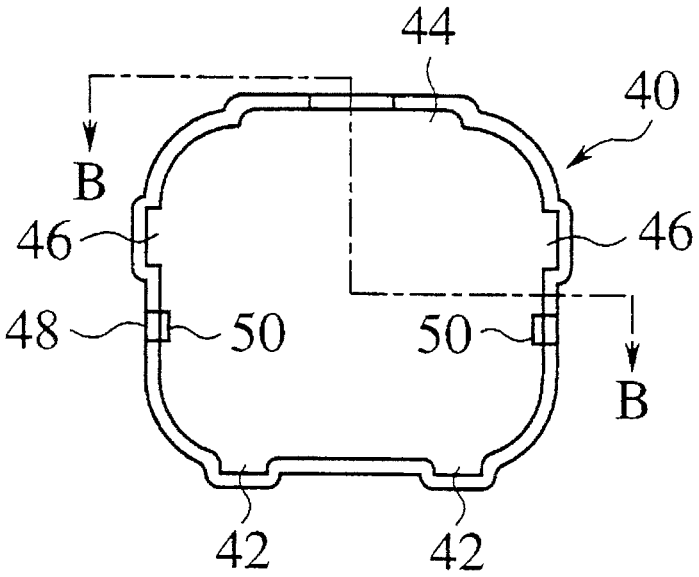
FIG. 2A is a front view showing the protective cover of the embodiment according to the present invention.
Figure 2B:
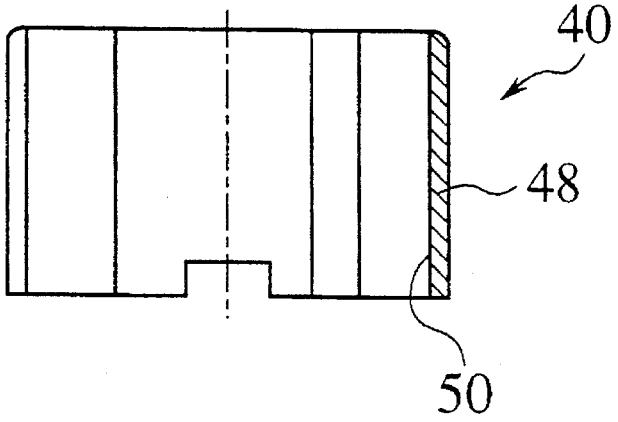
FIG. 2B is a cross-sectional view showing the protective cover of the embodiment, taken along the line B—B in FIG. 2A.

As shown in FIG. 1, the waterproof connector 1 has a female connector housing 30 and a protective cover 40. The protective cover 40 is formed of a hard plastic and attached to the female connector housing 30 to cover the female connector housing 30, only when necessary.

Figure 3:
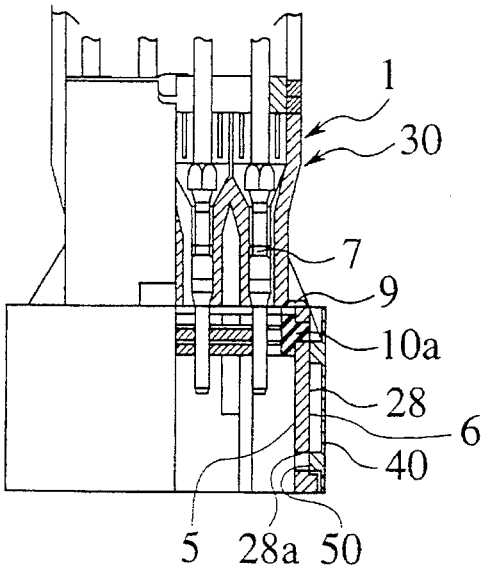
FIG. 3 is a half plane and cross-sectional view showing the embodiment of the waterproof connector housing according to the present invention.
Figure 4A:
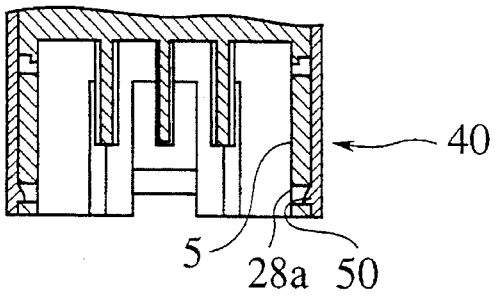
FIG. 4A is a plane view showing an essential portion of the waterproof connector according to the present invention.
Figure 4B:
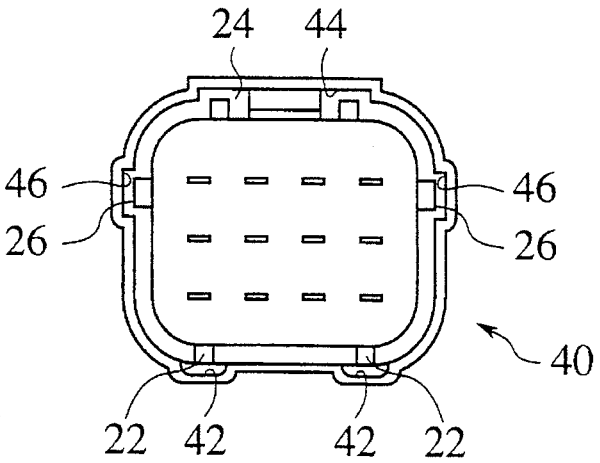
FIG. 4B is a front view showing the same essential portion of the waterproof connector according to the present invention.

With reference to FIGS. 3, the female connector housing 30 is formed into a square cylindrical shape and also formed of a plastic through molding process. The female connector housing 30 is formed with a mating opening 5 mated with a male connector housing (not shown) in front portion thereof. Inside the mating opening 5, ends of a plurality of metal terminals 7 housed in the female connector housing 30 are arranged passing through an inner wall 9. Therefore, when the male connector housing is mated with the mating opening 5 of the female connector housing 30, the terminals 7 housed in the female connector housing 30 can be engaged with other terminals arranged in the male connector housing.

Further, a rubber sealing packing 10 of roughly square shape is disposed in tight contact with the inner wall 9 of the female connector housing 30 at a corner portion (at which the inner wall 9 and the circumferential wall 6 of the female connector housing 30 intersect each other) in such a way as to enclose the metal terminals 7. Therefore, when the male connector is mated with the female connector housing 30, since the front end portion of the male connector housing is brought into tight contact with the packing 10 housed in the female connector housing 30, it is possible to seal a space between the front end portion of the male connector housing and the inner wall 9 of the female connector housing 30.

Further, the female connector housing 30 is formed with two side rubber through holes 12 (as shown in FIG. 1) in both the circumferential walls 6 of the female connector housing 30 to support the packing 10 in position within the female connector housing 30 and further to allow the position of the packing 10 to be well confirmed from the outside. Therefore, the packing 10 is left exposed outward through these through holes 12. Further, in FIGS. 1 and 3, the reference numeral 10*a* denotes an exposed surface of the rubber packing 10.

Further, the female connector housing 30 is formed with a top outward convex portion 24, two side outward convex portions 26, and two bottom outward convex portions 22 all on the outer wall surface thereof. In addition, two side slots (grooves) 28 each having a lock hole (locking means) 28*a* at each front end thereof are formed on both sides under the two side outward convex portions 26, respectively.

On the other hand, as shown in FIG. 1 and 3, the protective cover 40 is also formed into a square cylindrical shape so as to be fitted to the outer circumferential surface 6 of the mating opening 5 of the female connector housing 30. The protective cover 40 is formed with a top outward concave portion 44 (fitted to the outer surface of the top outward convex portion 24), two side outward concave portions 46 (fitted to the outer surfaces of the two side outward convex portions 26), and two bottom outward concave portions 42 (fitted to the outer surfaces of the two outward convex portions 22) all in the inner wall surface thereof. In addition, the protective cover 40 is formed with two side flexible arms 48 each having a lock projection (locking means) 50 at each free end thereof.

Therefore, when the protective cover 40 is engaged with the outer wall surface of the female connector housing 30, since the flexible arms 48 of the protective cover 40 are engaged with the slots 28 of the female connector housing 30, and further since two lock projection 50 of the protective cover 40 are engaged with the lock holes 28*a* of the female connector housing 30, the protective cover 40 can be fixed to the female connector housing 30 in position.

Further, the axial length of the square cylindrical protective cover 40 is formed sufficiently long so that the exposed surfaces 10*a* of the packing 10 can be well covered by the protective cover 40.

In assembly, the protector cover 40 is slid along the outer circumferential wall 6 of the mating opening 5 of the female connector housing 30 in the axial direction of the connector, as shown in FIG. 1 by engaging the respective concave portions 42, 44 and 46 of the protective cover 40 with the respective convex portions 22, 24 and 26 of the female connector housing 30, until the lock projections 50 can be firmly engaged with the lock holes 28*a*. Under these conditions, the exposed surfaces 10*a* of the packing 10 can be well covered by the protective cover 40.

Accordingly, since the protective cover 40 can be attached to the female connector housing 30 only where necessary, it is possible to improve the waterproof characteristics only where required. In other words, it is possible to provide two types of waterproof connectors. That, is, when the protective cover 40 is attached, since the exposed surfaces 10*a* of the packing 10 can be firmly covered by the protective cover 40, even if a high-pressure washing water Jet stream is applied against the waterproof connector, the packing 10 can be securely protected from the high-pressure washing water Jet stream, so that it is possible to prevent the packing from being deformed by the water pressure, thus providing a high-pressure resistant waterproof connector.

On the other hand, when the protective cover 40 is not attached to the female connector housing 30, the connector 1 can be used as the ordinary waterproof connector under the ordinary (static seal) conditions.

As a result, since the basic type female connector housing 30 can be molded with the use of a single molding die, and since the protective cover 40 can be additionally attached to the female connector housing 30 as an optional parts, only where necessary, it is possible to manufacture the high-pressure waterproof connector (not mass-production products) at a relatively low cost.

Further, the protective cover 40 is preferably formed of a hard plastic and formed with a square cylindrical shape in correspondence to the outer shape of the female connector housing 30. In addition, the protective cover 40 is fitted to and further locked with the outside of the female connector housing 30 via locking means. Consequently, the protective cover 40 is not easily moved relative to the female connector housing 30, even if a high-pressure washing water jet stream is applied against the waterproof connector 1, so that the exposed portions 10*a* of the packing 10 can be perfectly covered and thereby the waterproof characteristics of the packing can be maintained for many hours. Further, since the protective cover 40 can be attached easily to the female connector housing 30, from the outside, after the packing 10 has been attached to the female connector housing 30, the engagement conditions of the packing 10 with the female connector housing 30 can be confirmed.

As described above, in the waterproof connector according to the present invention having a packing supported by holes formed in the connector housing (for packing position confirmation), it is possible to provided two types of the waterproof connectors of low and high waterproof characteristics, by not attaching or by simply attaching the protective cover to the connector housing, after the connector terminals and the packing have been all assembled in position within the connector housing. As a result, it is possible to economize the number of the molding dies and thereby to reduce the cost of the waterproof connector, in particularly of the specific high-pressure type waterproof connector.

Further, since the connector housing and the protective cover are formed into square cylindrical shape and further since the locking means is provided between the connector housing and the protective cover, the protective cover can be stably and firmly engaged with the outside surface of the connector housing, without being rotated by a high-pressure washing water jet stream.

What is claimed is:

1. A waterproof connector (1), comprising:

a connector housing (30) having an opening (5) engaged with a mated connector housing;

a packing (10) disposed within the opening of said connector housing, for sealing a space between the two mated connector housings, at least one part (10*a* ) of said packing being exposed outside through at least one hole (12) formed in said connector housing; and a protective cover (40) selectively attached to said connector housing from the outside at need, for covering at least one exposed part (10*a* ) of said packing according to a required degree of connector waterproof characteristics.

2. The waterproof connector of claim 1, wherein said connector housing (30) is formed with a pair of slots (28) each having a lock hole (28*a* ) at an end of each slot; and said protective cover (40) includes locking means having:

a pair of flexible arms (48) formed on both side surfaces thereof, respectively so as to be engaged with two slots (28) of the connector housing, separately; and a pair of lock projections (50) each formed at each free end of said flexible arms so as to be engaged with each lock hole (28*a* ) formed at each end of the slots, separately.

3. The waterproof connector of claim 1, wherein said protective cover (40) is formed of a hard plastic resin.

4. The waterproof connector of claim 1, wherein said protective cover (40) is formed into a cylindrical shape in correspondence to a shape of said connector housing, and further engaged with said connector housing being slid on and along an outer circumferential wall (6) of said connector housing.

5. The waterproof connector of claim 4, wherein said connector housing (30) has a plurality of convex portions (22, 24, 26) formed in an outer wall surface thereof, and said protective cover (40) has a plurality of concave portions (42, 44, 46) formed in an inner wall surface thereof so as to be engaged with a plurality of the outer convex portions (22, 24, 26) of said connector housing, respectively.

* * * * *